United States Patent [19]

Fayos

[11] 4,120,523

[45] Oct. 17, 1978

[54] SAFETY FASTENING

[75] Inventor: D. Jose Antonio Navarro Fayos, Valencia, Spain

[73] Assignee: Montajes Electronicos Dorcas S.A., Siete Aguas, Spain

[21] Appl. No.: 818,543

[22] Filed: Jul. 25, 1977

[30] Foreign Application Priority Data

Jan. 26, 1977 [ES] Spain ..... 225.949

[51] Int. Cl.[2] ..... E05C 17/16

[52] U.S. Cl. ..... 292/268

[58] Field of Search ..... 70/93; 292/262, 263, 292/268, 270, 265, 267

[56] References Cited

U.S. PATENT DOCUMENTS

| | | | |
|---|---|---|---|
| 984,612 | 2/1911 | Spangler | 292/269 |
| 2,407,900 | 9/1946 | Paul | 70/93 |
| 3,924,885 | 12/1975 | Markovitch | 292/262 |
| 4,048,822 | 9/1977 | Lüling | 292/262 X |

*Primary Examiner*—Richard E. Moore

*Attorney, Agent, or Firm*—Darby & Darby

[57] ABSTRACT

An improved fastening device for use on doors and the like which includes a bolt, or latch, having a guide with stops therein in which slide a pair of pins on a flange which is to be fixedly attached to the door. The bolt has a mouth with a flared opening into which fits a rectangular, shaped pin of a catch which is attached to the door frame. The bolt can be moved with respect to the flange pins so that the mouth opening clears and accepts the latch pin. Also the bolt can pivot with respect to the pins to tilt and thereby allow a partial, controlled opening of the door in which position the mouth opening cannot clear the latch pin so that the door cannot be opened. In a further embodiment the latch pin can be rotated by a key so that the bolt can clear the pin with the door in a controlled open position.

9 Claims, 7 Drawing Figures

Figure 4:
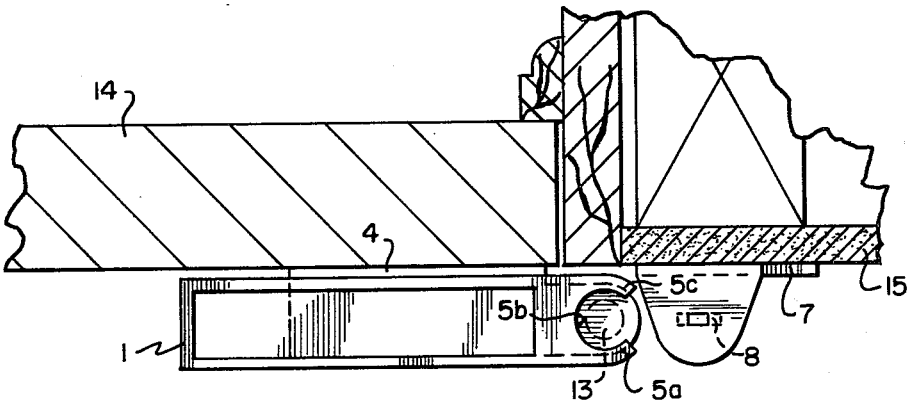

FIG. 1
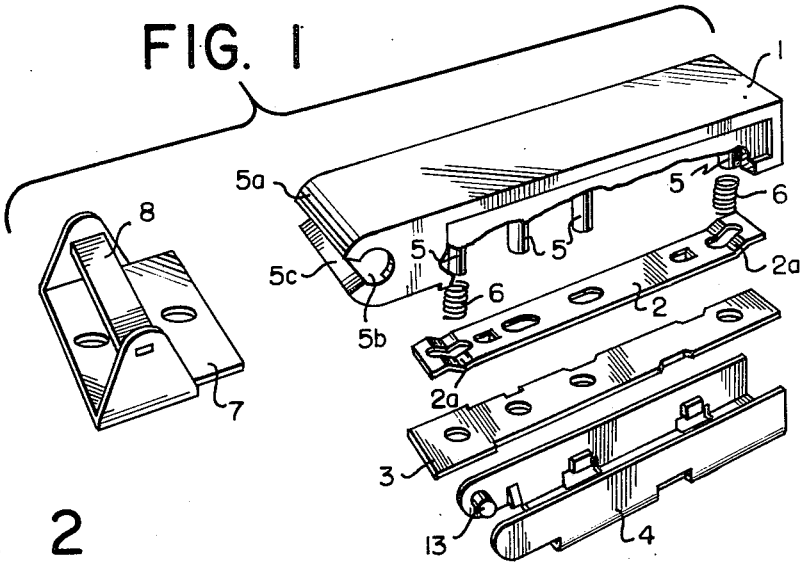
FIG. 2
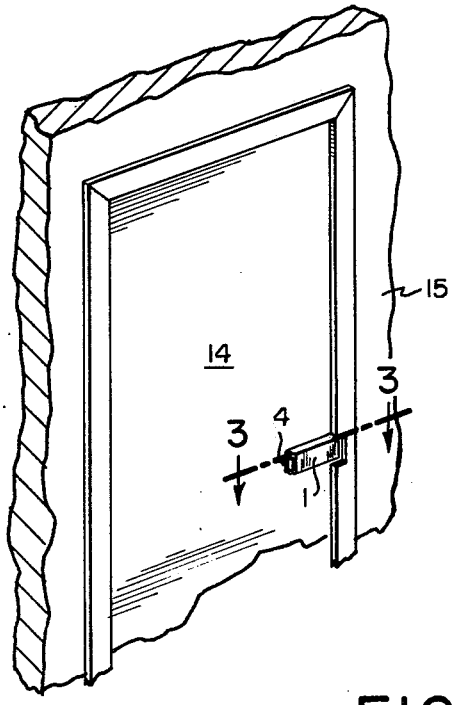
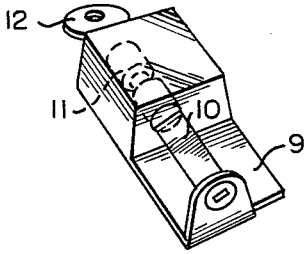
FIG. 6
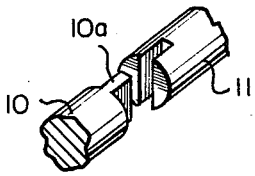
FIG. 6A
FIG. 3
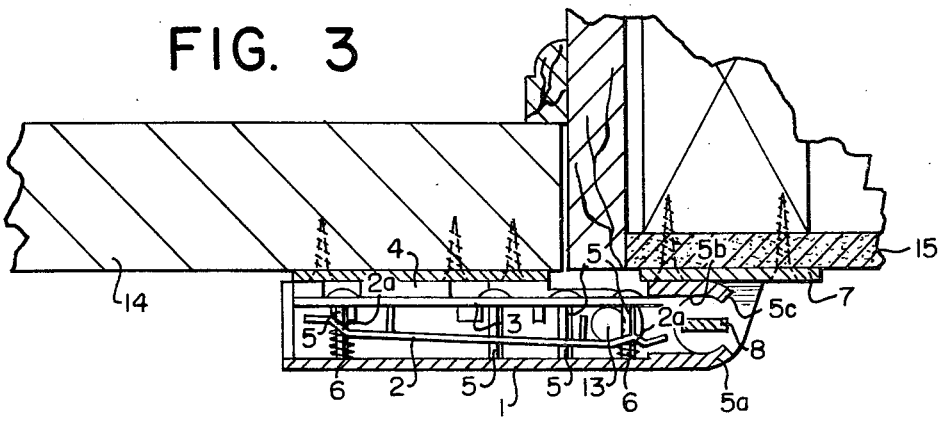

SAFETY FASTENING

The present invention relates to an improved safety fastening with the possibility of being used as an auxiliary bolt and, at the same time, as a means for controlling a door opening. All of this is accomplished in the invention in a compact and extremely rugged structure, capable of withstanding any attack against its integrity.

Various types of opening controllers are known in any type of door, but nearly all of them have weak points which make them quite vulnerable. For example, they can easily be broken from outside and, furthermore, their use is always conditioned to a person staying inside the premises it is wished to protect. For this reason they are not very popular and, in certain cases, are of no use.

On seeking solutions to this problem, a structure has been produced in which all the advantages of a safety fastening are combined for use with a controlled opening, such as a door. The device of the invention is impossible to force and, furthermore, provides the capability of leaving the premises to be protected uninhabited, while leaving both the fastening and the controlled opening locked.

A feature of the fastening of the invention concerns the link which joins the leaf of the door with the doorcase of the opening by a movable bar fitted in eccentrically with respect to a part fixed as wished in a particular position, either by construction or by voluntary locking operated by the user himself.

For this purpose, the fastening utilizes a sliding latch running on a fixed guide in a particular position of the door leaf. The link is capable of tilting on a point in its course of movement with respect to the edge of the door, so as not to lose engagement with a rectangular shaped catch fixed to the doorcase, whereby the door can be opened an amount corresponding to the chord formed by the length of the sliding latch and the amount of tilting on the fixed guide.

In order to understand the invention better, reference is made to the annexed drawings and which show a preferred embodiment of same, given by way of example and not of a limiting nature.

Figure 5:
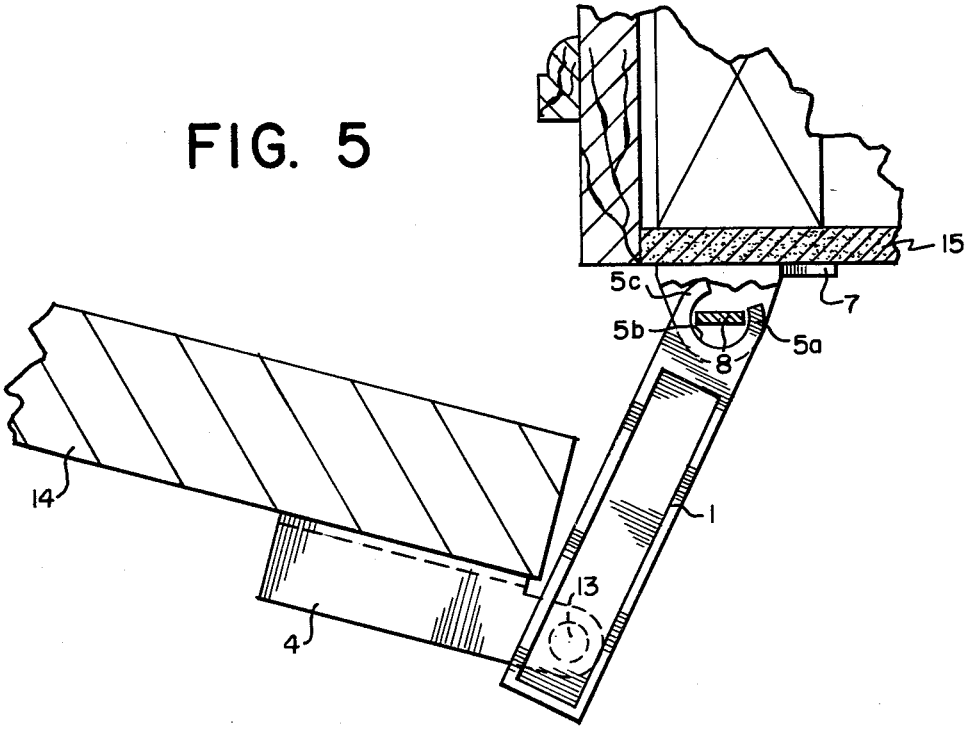

In the drawings:

FIG. 1 is a perspective exploded view of the safety fastening,

FIG. 2 is a perspective view and side elevation details of the fastening on a door with the door closed, FIG. 3 is a top view of the fastening with the latch in cross section in a closed position, with a cross section of the door and jamb, FIG. 4 is a top view of the latch in an open position, FIG. 5 is a perspective view showing the fastening in a controlled opening position and with the flight of the opening prefixed by assembly, and FIGS. 6 and 6A are perspective views of a different catch of the latch.

In the drawings, the body, or bolt, 1 of the latch portion of the fastening is a generally hollow rectangular body. From the lower face of the top wall of the body four pegs 5 extend downward perpendicular to the longitudinal axis of the body. One end 5*a* of the body is in the shape of a cross clamp with a cylindrical mouth 5*b* whose opening 5*c* is flared.

On the two end pegs 5, two helicoidal springs 6 are placed to maintain in tension against a plate 3 a strip 2, whose ends are slightly bent to produce steps 2*a*, one at the right end and two at the left. Strip 2 retains and defines the sliding of two pins 13 located on opposite sides of the head of a flange 4 which is a separate piece which is fixed to the leaf of the door 14. Pins 13 are fitted between the strip 2 and the body bottom plate 3, and move against the antagonistic action of the springs 6 maintaining a resilient support on the cover-bottom plate 3. When rivet-type fittings (not shown) have been made from the outside of plate 3 on the pegs 5, a solidly linked unit is formed in which the body can slide forward and backward with respect to the fixed flange 4 due to the sliding of the pins 13 along the resilient guide produced between the movable strip 2 and the fixed bottom plate 3. The sliding action stops when the pins 13 on the flange 4 engage the staggered stops 2*a* at the left and right of the strip thanks to the undulations at each end of strip 2. This makes the strip 2 rise against the springs 6 while fixing each position relatively of the body 1 as it slides with respect to flange 4.

This mutual link between the sliding bolt 1 and the flange 4, which is fixedly attached such as by screws to a door 14, is produced on an axis (the pins 13) which allows the bolt 1 to tilt completely by an amount which will be set and controlled according to the distance *d* (FIG. 5) between which the flange 4 is fixed relative to the edge of the leaf of the door 14 and the pins 13 which hinge the tilting of the bolt. This distance will be prefixed by placement using assembly templates (not shown) which are provided with the fastening system to avoid errors.

Once the flange 4 has been fixed on the leaf of the door 14, a sliding action of the bolt body 1 is provided, forwards and backwards, to the extent of the difference in length between the two components fitted in and sliding on the pins 13 along the guide provided between the strip 2 and the fixed cover plate 3. Strip 2 will yield on springs 6 for the passage of the pins 13 until encountering the stops 2*a* of the strip 2. The forward sliding of the bolt body 1 between the two stops 2*a* on the right-hand side of strip 2 (FIG. 3) lets it pass sufficiently on the leaf of the door 14 (see FIGS. 3 and 4) to cause the door jamb casing 15 on which a catch 7 is fixed to move the bolt between open and closed positions. Catch 7 includes a pair of upstanding tabs between which a rectangular cross-section stud 8 is mounted with the bigger horizontal side such that when the sliding bolt 1 goes forward, it will accept the said stud into its mouth 5*b*. On advancing, the bigger side of stud 8 is within opening 5*c* and is just about the diameter of the cylindrical opening 5*c*.

Once the catch stud 8 has been fitted in opening 5*c* of the bolt 1, it suffices to push or pull the door 14 to produce a tilting of the slide 1 on the axis formed by the pins 13. The pins 13, in turn, will slide along the guide between strip 2 and plate 3 up to the back step 2*a* (left in FIG. 3), with the mouth 5*b* of bolt 1 retained from coming out of the stud 8 of the catch 7, by the bolt having turned (see FIG. 5) with repect to stud 8. Bolt 1 pivots about an arc of somewhat less than 90° and the opening 5*c* of bolt mouth 5*b* is also somewhat less than 90°. While bolt 1 tilts, opening 5*c* never encounters the smaller side of the stud 8 whose bigger side is wider than the mouth opening 5*b*. This allows a partial opening of the leaf of the door 14 which is extremely effective and very solid.

The distance *d* (FIG. 5) provides the turning moment for producing the swinging of bolt 1 at the moment of the bolt 1 clearing the edge of the door and the tilting of the bolt.

To be able to open the door, the course of the slide of the bolt 1 must be guided to permit the stud 8 of the catch 7 to slip out of bolt opening 5*c* (see FIG. 4). The door can be opened easily when the controlled opening function (FIG. 5) is not used.

In some cases it may be desired to leave the controlled opening function as an auxiliary feature of the fastening device when leaving the house locked, and without anyone inside. This is not possible with normal means. For this purpose, as shown in FIG. 6 and FIG. 6A, it is necessary to have a special catch 9 whose stud 10 is rotatable in its mounting body by a key 12 having a forked end 11 which engages a tab 10*a* on stud 10. The controlled opening feature is as previously described with respect to FIG. 5, but now by operating the key 12 and turning the stud 10 until it is placed in a position where its narrow side is perpendicular to the arc of the opening 5*c* to mouth 5*b*, the bolt 1 can be cleared from stud 10 by further pushing of the door. This allows the door to be left in a partially open position and entrance to the house, obtained on turning the stud 10. This is not possible without the action of the key 12, as the stud 10 normally remains fixed in the closed position with respect to slide 1 and only turns on inserting the key 12 which the user will operate. The key is made so that it can only be withdrawn and removed by returning the stud 10 to the closed position (FIG. 5) in which the bolt can be fixed. With the stud 10 rotated to the position (FIG. 6) where the bolt can be cleared from it with the door partly opened, the mouth opening 5*b* will not clear the partly turned stud to permit the bolt to be locked again (FIG. 4). This solves the problem of being able to leave the device in the controlled opening function with no one inside the house.

I claim:

1. An opening controller device for a door or the like comprising:

an elongated latch means of a given size and a catch means, said latch and said catch means adapted for mounting adjacent each other, one on the door and the other on a support opposite at least one side of the door, said catch means including a catch member having first and second sides, said first side being of a larger dimension than said second side, said latch means having an end formed with an opening and a mouth providing entry to and exit from said opening, said opening being of a size to accept the entry of the second side of the catch member but to prohibit withdrawal of the latch means from said catch member when said first side of the catch member is presented to the exit of said opening, and means for slidably and pivotally mounting said latch means relative to said catch member and to the member on which it is mounted, said mounting means permitting said opening at the end of said latch means to have the catch member accepted therein when the latch means is slidably moved to said catch member with the second side thereof presented to the mouth of the opening and to permit pivoting of the latch means relative to said catch member when the door is pivoted open relative to the support means so that the catch member is prevented from leaving said opening by the first side of the catch member being presented to the exit of the opening.

2. A device as in claim 1 wherein said mounting means comprises resilient guide means attached to said latch means, and a plate for mounting to one of said door and support means, said guide means being slidable and pivotable with respect to said plate.

3. A device as in claim 2 wherein said resilient guide means forms a track, said plate including at least one pin which slides in the track and forms a pivot for the latch means.

4. A device as in claim 3 wherein said resilient guide means is formed with a plurality of stops for the pin to set the position of the pin and the latch means, a first stop being at a position where the latch means opening is slidably moved over the catch member when the door is closed and a second stop being at a position remote from the first position to which the latch means slidably moves when the door is open and at which the latch means pivots with respect to said catch member.

5. A device as in claim 4 wherein the guide means has a third stop to permit the latch means to extend further in a direction beyond said first stop whereby the latch means opening can be withdrawn from the catch member.

6. A device as in claim 3 wherein said latch means pivot pin is located over the other one of the door and support members on which the latch means is mounted.

7. A device as in claim 1 wherein said catch member is fixedly mounted relative to said catch means.

8. A device as in claim 1 further comprising means for rotating said catch member of said catch means so that the second side of the catch member can be presented to the exit of the latch means opening when the latch means is in a pivoted position.

9. A device as in claim 8 wherein the means for rotating the catch member comprises a key insertable into said catch means, said catch member having means engageable with said key and operated thereby.

* * * * *